US008689990B2

(12) United States Patent
Hdeyasu et al.

(10) Patent No.: US 8,689,990 B2
(45) Date of Patent: Apr. 8, 2014

(54) METAL CAP AND BOTTLE WITH CAP

(75) Inventors: Muto Hdeyasu, Shizuoka (JP); Munetaka Ida, Shizuoka (JP); Eiji Yamamoto, Shizuoka (JP)

(73) Assignee: Universal Can Corporation, Tokyo (JP)

( * ) Notice: Subject to any disclaimer, the term of this patent is extended or adjusted under 35 U.S.C. 154(b) by 0 days.

(21) Appl. No.: 13/697,506

(22) PCT Filed: Apr. 25, 2011

(86) PCT No.: PCT/JP2011/002403

§ 371 (c)(1),
(2), (4) Date: Nov. 12, 2012

(87) PCT Pub. No.: WO2011/142092

PCT Pub. Date: Nov. 17, 2011

(65) Prior Publication Data

US 2013/0056436 A1 Mar. 7, 2013

(30) Foreign Application Priority Data

May 14, 2010 (JP) ..... 2010112535

(51) Int. Cl.
*B65D 41/34* (2006.01)
*B65D 51/16* (2006.01)

(52) U.S. Cl.
USPC ..... 215/350; 215/307; 215/252

(58) Field of Classification Search
USPC ..... 215/252, 307, 341, 349–351
See application file for complete search history.

(56) References Cited

U.S. PATENT DOCUMENTS

| | | | | |
|---|---|---|---|---|
| 4,007,851 | A * | 2/1977 | Walker | 215/307 |
| 7,581,651 | B2 * | 9/2009 | Matukawa et al. | 215/252 |
| 8,167,161 | B2 * | 5/2012 | Ichimura et al. | 220/303 |
| 2003/0098286 | A1 | 5/2003 | Bloom et al. | |
| 2005/0051559 | A1 * | 3/2005 | Yamashita | 220/366.1 |
| 2006/0068230 | A1 | 3/2006 | Faehler | |
| 2008/0073309 | A1 * | 3/2008 | Nakajima et al. | 215/252 |
| 2010/0065528 | A1 * | 3/2010 | Hanafusa et al. | 215/347 |

FOREIGN PATENT DOCUMENTS

| | | | |
|---|---|---|---|
| JP | 54-148688 | A | 11/1979 |
| JP | 5032260 | A | 2/1993 |
| JP | 3306732 | B2 | 7/2002 |
| JP | 2006027663 | A | 2/2006 |
| WO | WO-2006068230 | A1 | 6/2006 |

OTHER PUBLICATIONS

Inernatianal Search Report of PCT/JP2011/002403, Jul. 2009.

* cited by examiner

*Primary Examiner* — Anthony Stashick
*Assistant Examiner* — James N Smalley
(74) *Attorney, Agent, or Firm* — Edwards Wildman Palmer LLP; Jeffrey D. Hsi

(57) ABSTRACT

The present invention relates to a metal cap which seals the mouth of a bottle for drinking or the like, and a bottle with the cap which is furnished therewith.

6 Claims, 3 Drawing Sheets

(a) (b)

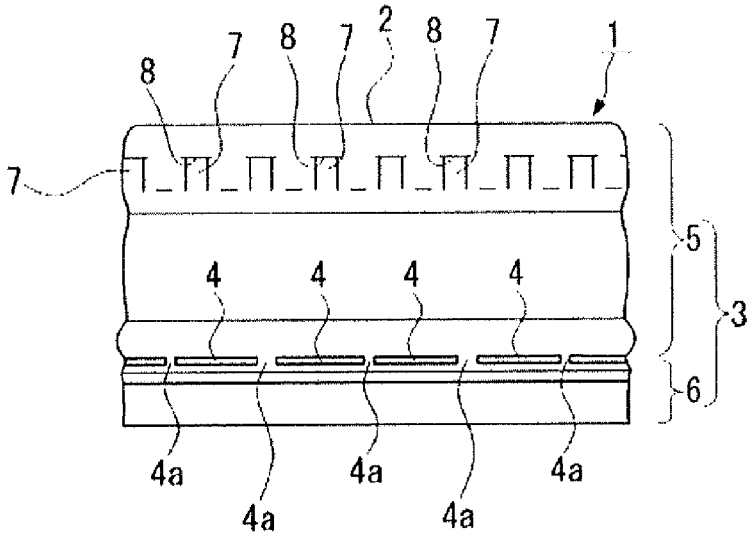
FIG. 1
FIG. 2
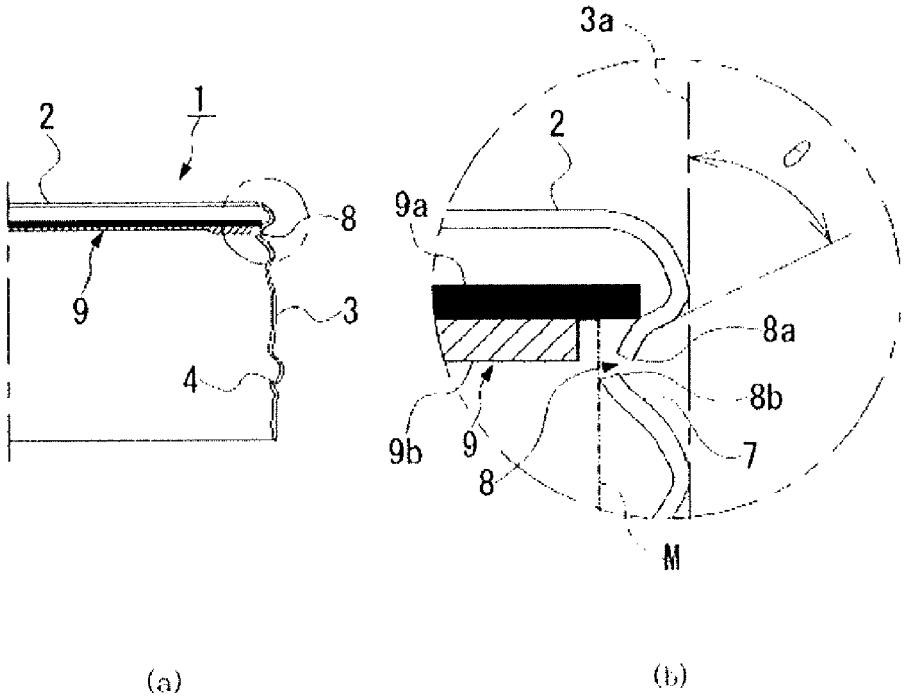

FIG. 3
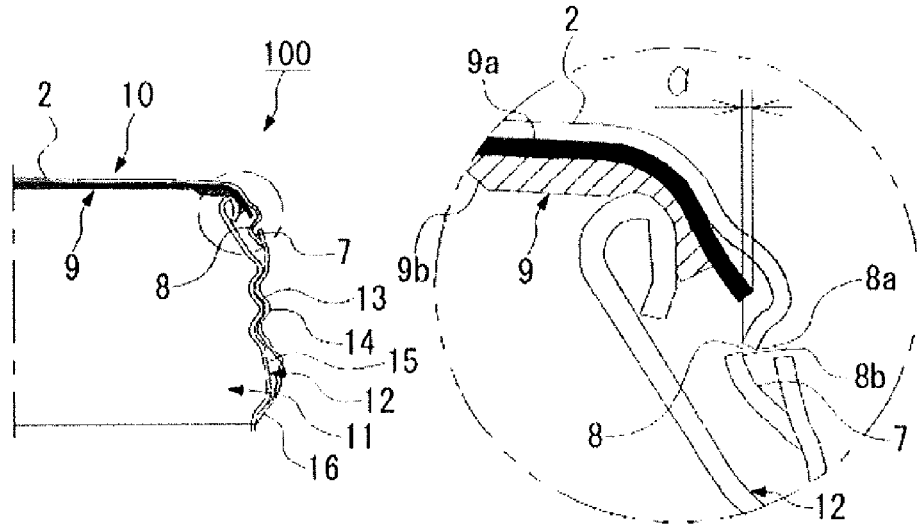
(a) (b)
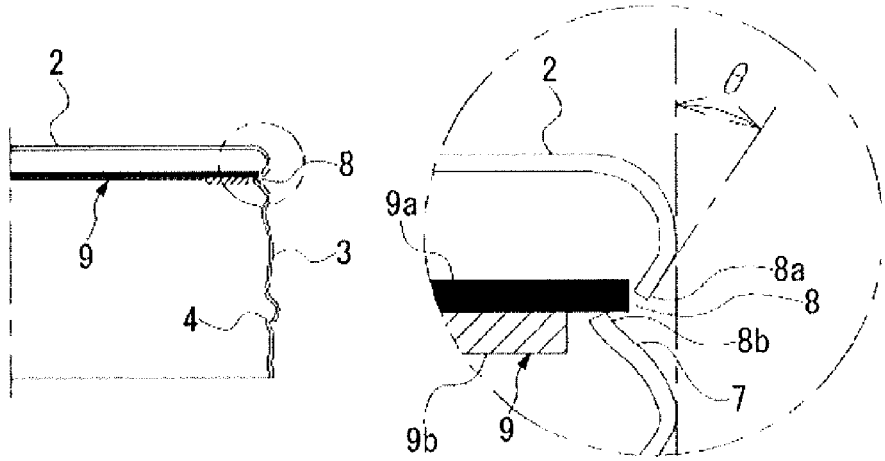
FIG. 4

(a) (b)

METAL CAP AND BOTTLE WITH CAP

CROSS-REFERENCE TO RELATED APPLICATIONS

This application is the national phase under 35 U.S.C. §371 of PCT International Application No. PCT/JP2011/002403, filed Apr. 25, 2011, which claims the benefit of Japanese Patent Application No. 2010-112535, filed May 14, 2010, the entire contents of the aforementioned applications are hereby incorporated herein by reference.

TECHNICAL FIELD

The present invention relates to a metal cap which seals the mouth of a bottle for drinking or the like, and a bottle with the cap which is furnished therewith.

BACKGROUND ART

Conventionally, with respect to caps which adhere to the mouth sections of metal bottles made of steel, aluminum alloy or the like, it is known that vent holes (also called knurl slits or vent slits) are formed in the vicinity of the upper end of the cap for purposes of releasing internal pressure and discharging gas from within the bottle body to the exterior when the cap is opened by rotational manipulation. For example, Patent Document 1 describes a cap including: a cap body in which multiple protrusions project from the inner surface of a skirt wall in the vicinity of a ceiling wall; and a liner which engages with the aforementioned protrusions at multiple sites at the rim, and which is arranged on the inner side of the ceiling wall in a non-adjoined state; wherein the aforementioned protrusions are formed by cutting incisions at the periphery of the cap body, and by pressing and bending the cut sections toward the inner side of the cap. With this cap, the incisions forming the aforementioned protrusions function as vent holes.

Patent Document 2 describes a cap that is screwed onto a mouth section of a bottle, including: a cap body which is provided with a top plate section, and a peripheral wall section that substantially hangs down from the rim of the pertinent top plate section; and a liner which is arranged so as to cover the inner surface of the top plate section on the inner side of the pertinent cap body; wherein liner supports which successively extend inward in the radial direction of the cap body from the rim of the top plate section are multiply formed at intervals in the circumferential direction at the top of the peripheral wall section, and the liner is arranged at the upper end of the pertinent liner supports in the axial direction. With this cap, slits are formed as vent holes at the bottom end of the recesses of knurls that are multiply formed in the circumferential direction of the peripheral wall section, and the recesses serve as the liner supports. In addition, with this cap, the slits and liner supports that constitute the vent holes are formed after prearrangement of the liner on the inner surface of the top plate section.

Thus, with the aforementioned conventional caps, the protruding portions of slits formed as vent holes are pressed inward to serve as protrusions or liner supports, and these serve as hooks which prevent displacement by engaging with the liner.

PRIOR ART REFERENCES

Patent Documents

Patent Document 1: Japanese Patent Application Laid-Open No. 2006-27663 (FIG. 6)

Patent Document 2: Japanese Patent Application Laid-Open No. 2005-280764 (FIG. 1)

DISCLOSURE OF INVENTION

Problems to be Solved by the Invention

The following problems remain with the aforementioned prior art. That is, when the liner that closely adheres to the bottle mouth is not fully peeled off from the bottle mouth at the time of unsealing, and when the still-closely-adhering liner is pulled downward relative to the cap, as in the technology of the aforementioned Patent Document 1, in the case where the liner engages with the underlying protrusions of the vent holes, there is a risk that the outer rim of the liner may be caught at the distal ends of the underlying protrusions that are the breaking portions, bending the entire liner, and causing the liner to fall off by separating from the outer rim of the liner that is not caught. Even in the case where it does not fall off, the periphery of the liner may rub against the edges of the underlying protrusions of the vent holes so that a smooth sensation is not obtained when unsealing is performed, and there may be cases where the liner is somewhat pared off. Furthermore, with the technology of the aforementioned Patent Document 2, when it is undertaken to insert the liner after forming the slits and recesses constituting the vent holes, there is a risk that the liner may catch on the distal ends of the upper protrusions of the slits that are the breaking portions so that it cannot be smoothly inserted, and also that the liner may be damaged due to friction. Consequently, it is necessary to form the slits and recesses that constitute the vent holes after arranging the liner in advance on the inner surface of the top plate, which is troublesome in terms of the cap work process.

The present invention was made in light of the foregoing problems, and its object is to provide a metal cap and a bottle with cap which prevent slippage of the liner during unsealing, and which enable smooth unsealing and liner insertion.

Means for Solving the Problems

In order to solve the aforementioned problems, the present invention adopts the following configuration. That is, the metal cap of the present invention includes a top plate section which is disposed above, and a cylindrical section which substantially hangs down from a rim of the pertinent top plate section, and seals a mouth of a bottle after a liner has been inserted onto the inner surface of the aforementioned top plate in a non-adhering state; wherein the aforementioned cylindrical section has vent holes in the vicinity of the aforementioned top plate section which are formed with a slit-like opening in the circumferential direction, and which release internal pressure during unsealing, and upper protrusions and lower protrusions formed by bending an upper opening end and a lower opening end of the pertinent vent hole inward in the radial direction of the aforementioned cylindrical section; wherein the distal end of the aforementioned upper protrusion is positioned further inward in the radial direction than the outer rim of the liner when the liner is inserted, and is also positioned at the same position in the radial direction as the distal end of the aforementioned lower protrusion, or further outward in the radial direction than the aforementioned distal end.

With this metal cap, as the distal end of the upper protrusion of the vent hole is positioned further inward in the radial direction than the outer rim of the liner when the liner is inserted, and is positioned at the same position in the radial direction as the distal end of the lower protrusion or further outward in the radial direction than the aforementioned distal end, although the periphery of the inserted liner engages with the upper surface of the upper protrusion during unsealing, it is possible to prevent the liner from catching on the distal end that is the breaking portion, and falling off due to bending. In addition, as the distal end of the upper protrusion of the vent hole is positioned further outward in the radial direction than the lower protrusion, the lower protrusion serves as a guide during insertion of the liner, and restrains the liner from catching on the distal end of the upper protrusion by blocking contact between the liner and the distal end of the upper protrusion.

In the metal cap of the present invention, the aforementioned liner is provided with a sliding layer disposed on the inner surface side of the aforementioned top plate section, and a sealing layer which is superimposed onto the aforementioned sliding layer by mold forming after the aforementioned insertion, and which is more flexible and has a smaller outer diameter than the aforementioned sliding layer, wherein the distal end of the aforementioned upper protrusion is positioned further inward in the radial direction than the outer rim of the aforementioned sliding layer of the aforementioned liner, and the distal end of the aforementioned lower protrusion is positioned further outward in the radial direction than the outer rim of the aforementioned sealing layer when the liner is inserted. That is, with this metal cap, as the distal end of the upper protrusion is positioned further inward in the radial direction than the outer rim of the sliding layer of the liner, and as the distal end of the lower protrusion is positioned further outward in the radial direction than the outer rim of the sealing layer when the liner is inserted, contact between the distal end of the upper protrusion of the vent hole and the sliding layer of the liner during insertion can be prevented by the lower protrusion, and the metal mold that is inserted inward during mold forming of the sealing layer after insertion can be center positioned by the lower protrusion.

In the metal cap of the present invention, the distal end of the aforementioned upper protrusion is bent further downward to orient the surface of the distal end downward. That is, with this metal cap, as the distal end of the upper protrusion is bent further downward to orient the distal end downward, the outer rim of the liner that surpasses the lower protrusion due to elasticity during insertion can be inhibited from contacting the distal end of the upper protrusion, further inhibiting the liner from catching thereon.

The bottle with cap of the present invention includes a bottle body, and a metal cap which covers the mouth of the pertinent bottle body, wherein the aforementioned metal cap is the aforementioned metal cap of the present invention. That is, with this bottle with cap, as the metal cap is the aforementioned metal cap of the present invention, it is possible to prevent the liner from falling off during unsealing, and obtain a smooth gripping sensation.

Effects of the Invention

According to the present invention, the following effects are obtained. That is according to the metal cap of the present invention, as the distal end of the upper protrusion of the vent hole is positioned further inward in the radial direction than the outer rim of the liner, and is positioned at the same position in the radial direction as the distal end of the lower protrusion or further outward in the radial direction than the pertinent distal end when the liner is inserted, it is possible to prevent the liner from falling off during unsealing, and enable smooth unsealing and liner insertion. Accordingly, with the bottle with cap that adopts the metal cap of the present invention, it is possible to prevent the liner from falling off during unsealing, and obtain a smooth gripping sensation.

BRIEF DESCRIPTION OF THE DRAWINGS

FIG. 1 is a side view which shows a metal cap in one embodiment of the metal cap and the bottle with metal cap of the present invention.

FIG. 2 is a cross-sectional view of the metal cap in a state of liner insertion, and an enlarged cross-sectional view of essential components in the present embodiment.

FIG. 3 is a cross-sectional view of a severed cap portion, and an enlarged cross-sectional view of essential components which show the bottle with cap in the present embodiment.

FIG. 4 is a cross-sectional view of a metal cap in a state of liner insertion, and an enlarged cross-sectional view of essential components in a comparative example of the metal cap and the bottle with metal cap of the present invention.

DESCRIPTION OF THE EMBODIMENTS

Figure 5:
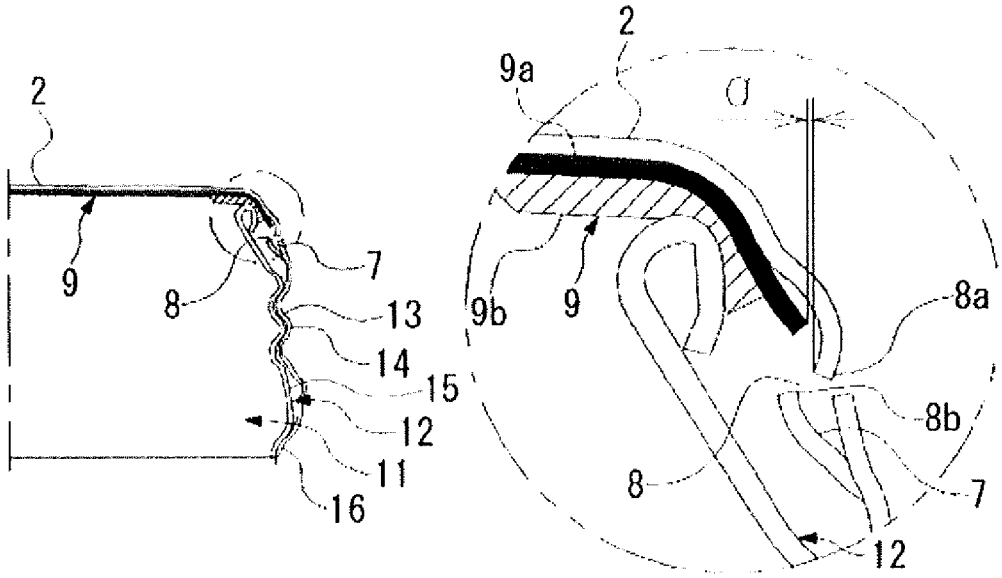
FIG. 5 is a cross-sectional view of a severed cap portion, and an enlarged cross-sectional view of essential components which show a bottle with cap in a comparative example of the metal cap and the bottle with metal cap of the present invention.

An embodiment of the metal cap and the bottle with metal cap of the present invention is described below with reference to FIG. 1 to FIG. 5.

As shown in FIG. 1 and FIG. 2, a metal cap 1 of the present embodiment is, for example, a pilfer proof cap (hereinafter "PP cap") which covers and seals a mouth section (mouth) of an aluminum or aluminum alloy (metal) bottle body with a bore diameter of 38 mm. This metal cap 1 is a cap in which aluminum or aluminum alloy material is molded into a cup shape, and is provided with a top plate section 2 disposed above, and a cylindrical section 3 which substantially hangs down from the rim of the pertinent top plate section 2.

This metal cap 1 seals the mouth of the bottle body after a liner 9 has been inserted onto the inner surface of the top plate section 2 in a non-adhering state. The aforementioned cylindrical section 3 has an upper cylinder section 5 and a lower cylinder section 6 divided above and below by interposition of a slit 4 formed intermittently in the circumferential direction, and is shaped so that the upper cylinder section 5 and the lower cylinder section 6 are connected by multiple bridges 4*a* formed between neighboring slits 4.

The aforementioned cylindrical section 3 has multiple knurl recesses 7 which are formed in alignment in the circumferential direction in the vicinity of the top plate section 2, knurl slits 8 which are vent holes that are formed with slit-like openings in the circumferential direction in the knurl recesses 7 and that release internal pressure during unsealing, and upper protrusions 8*a* and lower protrusions 8*b* which are formed by bending the upper opening end and lower opening end of the pertinent knurl slit 8 inward in the radial direction of the cylindrical section 3.

The aforementioned knurl recesses 7 increase the frictional resistance between the PP cap and the gripping finger during unsealing, thereby enabling easy unsealing without slippage of the hand.

The aforementioned knurl slit 8 is formed by cutting in the circumferential direction to a length identical to the width of the knurl recess 7 at the upper end of the knurl recess 7. This knurl slit 8 is a vent hole that serves to discharge gas within the bottle body to the exterior when the cap 1 (PP cap) attached to the bottle body is rotationally manipulated upward while breaking the bridges 4*a*.

The distal end of the upper protrusion 8*a* of the knurl slit 8 is positioned further inward of the radial direction than the outer rim of the liner 9 when the liner is inserted, and is positioned at the same position in the radial direction as the distal end of the lower protrusion 8*b* or further outward in the radial direction than the pertinent distal end. Furthermore, the distal end of the upper protrusion 8*a* is bent further downward to orient the surface of the distal end downward.

As shown in FIG. 2 (*b*), the upper protrusion 8*a* of the knurl slit 8 is bent at a prescribed angle θ (an angle relative to an imaginary line 3*a* parallel to the axis of the cylindrical section 3) toward the interior of the cylindrical section 3 with the point of origin at a bend at the top constituting a convexity on the other side. This angle θ is preferably set to within a range of 28-82°.

The liner 9 inserted into this metal cap 1 is provided with a sliding layer 9*a* disposed on the inner surface side of the top plate section 2, and a sealing layer 9*b* which is superimposed onto the sliding layer 9*a* either directly or with interposition of an intermediate layer such as a barrier layer by mold forming after insertion, and which is more flexible and has a smaller outer diameter than the sliding layer 9*a*. The aforementioned sliding layer 9*a* is configured from a hard discoid sheet formed with polypropylene or the like, and the aforementioned sealing layer 9*b* is formed with elastomer resin or the like in a laminar state by conducting mold forming on top of the hard sheet. Moreover, the distal end of the upper protrusion 8*a* of the knurl slit 8 is positioned further inward in the radial direction than the outer rim of the sliding layer 9*a* when the liner is inserted, and the distal end of the lower protrusion 8*b* is positioned further outward in the radial direction than the outer rim of the sealing layer 9*b*.

With respect to this liner 9, as shown in FIG. 2 (*b*), a metal mold M for mold forming is inserted into the metal cap 1 in a state where the sliding layer 9*a* with the hard sheet that has been inserted into the metal cap 1 is disposed in contact with the inner surface of the top plate section 2, and the sealing layer 9*b* is formed by conducting resin molding of elastomer resin or the like using the pertinent metal mold M. When this metal mold M for mold forming is inserted, the lower protrusion 8*b* of the knurl slit 8 plays the role of a guide of the metal mold M, conducting centering (positioning) of the metal mold M.

This sealing layer 9*b* is formed so that the peripheral portion that closely adheres to the mouth of the bottle is thicker than the central portion. The thickness of the liner 9 which contacts the upper protrusion 8*a* is preferably set to within a range of 0.1-2.0 mm. Moreover, the outer diameter of the liner 9 (the outer diameter of the sliding layer 9*a*) is determined according to the dimensions of the metal cap 1, and is set within the range of a diameter of 15-65 mm.

Next, the PP cap constituted by having the aforementioned metal cap 1 adhere to the mouth section, and a bottle with cap 100 sealed with the pertinent PP cap are described with reference to FIG. 3.

As shown in FIG. 3, the bottle with cap 100 of the present embodiment includes a bottle body 11 which is filled with a liquid such as a beverage and which is composed of aluminum or aluminum alloy, and a PP cap 10 (metal cap 1) which adheres to a mouth section 12 of the pertinent bottle body 11. With respect to this PP cap 10, the top plate section 2 is subjected to shoulder contraction treatment. This PP cap 10 adheres to the mouth section 12 of the bottle body 11 by forming a thread section 14 along the contour of a thread 13 in the upper cylinder section 5, and by forming a pilfer proof section 16 along the bottom of a protuberance 15 in the lower cylinder section 6.

The capping treatment of this PP cap 10 is conducted using a capping apparatus composed of a pressure block, screw roller, skirt roller, or the like. That is, an uneven section is formed at the shoulder of the metal cap 1 by pressing the top plate section 2 of the metal cap 1 that is covered by the mouth section 12 in the direction of the bottle bottom by a pressure block, and by conducting contraction treatment by pressure block in this state.

Furthermore, capping treatment is conducted by forming the thread section 14 by a screw roller in this state, and by winding the pilfer proof section 16 which is a skirt section around the protuberance 15 which is a coupler of the mouth section 12. That is, the thread 13 and the protuberance 15 are formed at the mouth section 12 of the bottle body 11 to which the metal cap 1 adheres, and the metal cap 1 covered thereby is plastically deformed so as to conform to the shape of the thread 13, protuberance 15, and so on. By this means, the metal cap 1 adheres to the mouth section 12 as the PP cap 10, and seals the bottle body 11, whereby the bottle 100 is obtained.

As stated above, the liner 9 is inserted and disposed on the inner side of the top plate section 2 of the PP cap 10, and the opening of the bottle body 11 is sealed by the pertinent liner 9. The overlap measurement a in the radial direction from the outer rim of the sliding layer 9*a* of the liner 9 to the distal end of the upper protrusion 8*a* of the knurl slit 8 after capping is preferably set to within the range of 0.10-1.52 mm.

As described above, with the metal cap 1 of the present embodiment, as the distal end of the upper protrusion 8*a* of the knurl slit 8 which is a vent hole is positioned further inward in the radial direction than the outer rim of the liner 9 when the liner is inserted, and as it is positioned at the same position in the radial direction as the distal end of the lower protrusion 8*b* or further outward in the radial direction than the pertinent distal end, the periphery of the inserted liner 9 engages with the upper surface of the upper protrusion 8*a* during unsealing, whereby the liner 9 can be prevented from catching on the distal end that is the breaking portion, and falling off due to bending.

As the distal end of the upper protrusion 8*a* of the knurl slit 8 is positioned further outward in the radial direction than the lower protrusion 8*b*, the lower protrusion 8*b* can restrain the liner 9 from catching on the distal end of the upper protrusion 8*a* during insertion of the liner 9 by serving as a guide, and by blocking contact between the liner 9 and the distal end of the upper protrusion 8*a*.

Furthermore, as the distal end of the upper protrusion 8*a* is positioned further inward in the radial direction than the outer rim of the sliding layer 9*a* of the liner 9 when the liner is inserted, and as the distal end of the lower protrusion 8*b* is positioned further outward in the radial direction than the outer rim of the sealing layer 9*b*, it is possible to prevent contact between the sliding layer 9*a* of the liner 9 and the distal end of the upper protrusion 8*a* of the knurl slit 8 by the lower protrusion 8*b* during insertion, and to center position the metal mold M, which is inserted inward during mold forming of the sealing layer 9*b* after insertion, by the lower protrusion 8*b*.

As the distal end of the upper protrusion 8*a* is bent further downward to orient the distal end downward, the outer rim of the liner 9 that surpasses the lower protrusion 8*b* due to elasticity during insertion can be inhibited from contacting the distal end of the upper protrusion 8*a*, further inhibiting the liner from catching thereon. Accordingly, with the bottle with cap adopting the metal cap 1 of the present invention, it is possible to prevent the liner 9 from falling off during unsealing, and obtain a smooth gripping sensation.

EXAMPLES

Next, the metal cap and the bottle with cap of the present embodiment were actually fabricated, and evaluation was conducted with respect to slippage of the liner during unsealing.

<Evaluation 1> First, visual evaluation of unsealed metal caps was conducted when fabrication was conducted by varying the angle θ of the upper protrusion of the knurl slit between 0° and 87°. Based on the number of upper protrusions and lower protrusions (hereinafter called "hooks") with displaced liners and the number of bottles (hereinafter called "cans"), hook displacement frequency was investigated to make an assessment of acceptability.

The aforementioned hook displacement frequency was calculated by the following numerical formula: hook displacement frequency=(number of displaced hooks×number of cans)÷number of evaluated cans. For example, in the case where the number of evaluated cans is 30, and where two of the cans have two displaced hooks, three of the cans have three displaced hooks, and three of the cans have four displaced hooks, the calculation is conducted as follows.

((2 hooks×2 cans)+(3 hooks×3 cans)+(4 hooks×3 cans)÷30 evaluated cans=0.83(hook displacement frequency)

With respect to assessment of acceptability, in the case of a liner displacement frequency of 1.0 or higher, a rating of "X" was given to indicate a risk of liner slippage; in the case of a hook displacement frequency of 0.4 or higher but less than 1.0, a rating of "Δ" was given to indicate that there is a risk of a defective external appearance even though liner slippage does not occur; and in the case of a hook displacement frequency of less than 0.4, a rating of "O" is given to indicate that there is no problem with liner slippage. Otherwise, in this example, 100 cans were assessed under the respective conditions at a low temperature of 5° C. The results are shown in Table 1. With respect to the angle θ, an average value was obtained by multiple measurements of hook cross-sections by X-ray.

TABLE 1

| Angle (°) | 0 | 16 | 22 | 28 | 42 | 53 | 66 | 82 | 87 |
|---|---|---|---|---|---|---|---|---|---|
| Hook displacement frequency | 2.55 | 1.99 | 0.86 | 0.25 | 0.24 | 0.22 | 0.10 | 0.00 | — |
| Acceptability assessment | X | X | Δ | ○ | ○ | ○ | ○ | ○ | — |
| Comments | | | | | | | | | Molding defects (hook cracking) |

Acceptability assessment: X = risk of slippage exists (≥1.0); Δ = possibility of defective external appearance although slippage does not occur (0.4-1.0); ○ = no problem (<0.4)

As shown in Table 1, satisfactory results were obtained in acceptability assessment of hook displacement frequency when the angle θ of the upper protrusion of the knurl slit was in a range of 28-82°. At an angle θ of 87°, as hook cracking occurred, evaluation was not conducted for reason of molding defects.

<Evaluation 2> Next, hook displacement frequency was investigated in the same manner described above when the overlap measurement a of the liner and the upper protrusion of the knurl slit was varied between −0.5 and 1.52 mm, and the results of acceptability assessment are shown in Table 2. FIG. 4 and FIG. 5 show the case where the overlap measurement a of the liner and the upper protrusion of the knurl slit is negative, i.e., a comparative example where the distal end of the upper protrusion 8*a* of the knurl slit 8 is positioned further outward in the radial direction than the outer rim of the liner 9. With respect to the overlap measurement a, an average value was obtained by conducting multiple measurements of hook cross-sections by X-ray.

TABLE 2

| | Overlap quantity (mm) | | | | | | | | |
|---|---|---|---|---|---|---|---|---|---|
| | −0.5 | −0.22 | 0.10 | 0.18 | 0.33 | 0.62 | 0.87 | 1.31 | 1.52 |
| Hook displacement frequency | 3.10 | 1.82 | 0.30 | 0.13 | 0.08 | 0.00 | 0.00 | 0.00 | 0.00 |
| Acceptability assessment | X | X | ○ | ○ | ○ | ○ | ○ | ○ | ○ |
| Comments | | | | | | | | | |

Hook angles and overlap measurements are average values obtained by multiple measurements of hook cross-sections by x-ray.

As shown in Table 2, satisfactory results were obtained in acceptability assessment of hook displacement frequency with overlap measurements a from 0.10 mm to 1.52 mm.

The technical scope of the present invention is not limited to the aforementioned embodiment and examples, and various modifications are possible within a scope that does not depart from the intent of the present invention. For example, although the present invention is well suited to a metal cap into which a liner of multilayer structure composed of at least a sliding layer and a sealing layer is inserted as described above, it may also be applied to a cap into which a single-layer liner is inserted.

Description of the Reference Numerals

1: metal cap, 2: top plate section, 3: cylindrical section, 7: knurl recess, 8: knurl slit (vent hole), 8*a*: upper protrusion, 8*b*: lower protrusion, 9: liner, 9*a*: sliding layer, 9*b*: sealing layer, 10: PP cap, 11: bottle body, 12: mouth section (mouth), 100: bottle (bottle with cap)

The invention claimed is:

1. A metal cap comprising:

a top plate section that is disposed above, a cylindrical section that substantially hangs down from a rim of said top plate section, and a liner for sealing a mouth of a bottle after the liner has been inserted onto an inner surface of said top plate in a non-adhering state;

wherein said cylindrical section has vent holes in the vicinity of said top plate section which are formed with a slit-like opening in the circumferential direction, and which release internal pressure during unsealing, and upper protrusions and lower protrusions formed by bending an upper opening end and a lower opening end of said vent hole inward in the radial direction of said cylindrical section;

wherein a distal end of said upper protrusion is positioned further inward in the radial direction than an outer rim of said inserted liner, and is also positioned at the same position in the radial direction as a distal end of said lower protrusion, or further outward in the radial direction than said distal end of said lower protrusion.

2. The metal cap according to claim 1, wherein said liner comprises a sliding layer disposed on the inner surface side of said top plate section, and a sealing layer which is superimposed onto said sliding layer by mold forming after said sliding layer has been inserted into the inside of the metal cap, and which is more flexible and has a smaller outer diameter than said sliding layer;

wherein the distal end of said upper protrusion is positioned further inward in the radial direction than the outer rim of said sliding layer of said liner, and the distal end of said lower protrusion is positioned further outward in the radial direction than the outer rim of said sealing layer when said liner is inserted.

3. The metal cap according to claim 1, wherein the distal end of said upper protrusion is bent further downward to orient the surface of the distal end downward.

4. A bottle with cap, comprising a bottle body, and a metal cap which covers the mouth of said bottle body, wherein said metal cap is metal cap according to claim 1.

5. The metal cap according to claim 1, wherein an angle $\theta$ of the upper protrusion is in a range of 28-82°.

6. The metal cap according to claim 1, wherein an overlap measurement of the liner and the upper protrusion is in a range of 0.10-1.52 mm.

* * * * *